US006151881A

United States Patent [19]

Ai et al.

[11] Patent Number: 6,151,881

[45] Date of Patent: Nov. 28, 2000

[54] AIR SEPARATOR FOR GAS TURBINES

[75] Inventors: Toshishige Ai; Yoichi Iwasaki; Sunao Aoki; Yukihiro Hashimoto; Kiyoshi Suenaga, all of Takasago, Japan

[73] Assignee: Mitsubishi Heavy Industries, Ltd., Tokyo, Japan

[21] Appl. No.: 09/242,293

[22] PCT Filed: Jun. 18, 1998

[86] PCT No.: PCT/JP98/02688

§ 371 Date: Feb. 11, 1999

§ 102(e) Date: Feb. 11, 1999

[87] PCT Pub. No.: WO98/59156

PCT Pub. Date: Dec. 30, 1998

[30] Foreign Application Priority Data

Jun. 20, 1997 [JP] Japan ..... 9-164070
Jun. 20, 1997 [JP] Japan ..... 9-164071

[51] Int. Cl.[7] ..... B63H 1/14

[52] U.S. Cl. ..... 60/39.75; 415/115; 416/95; 416/96 R; 416/97 R

[58] Field of Search ..... 60/39.75; 415/115, 415/116, 111, 174.5, 230; 416/95, 96 R, 97 R

[56] References Cited

U.S. PATENT DOCUMENTS 3,602,605 8/1971 Lee et al. ..... 415/116
5,394,687 3/1995 Chen et al. ..... 60/39.75
5,951,250 9/1999 Suenaga et al. ..... 416/97 R

FOREIGN PATENT DOCUMENTS 8-177526 7/1996 Japan .
8-284687 10/1996 Japan .
9-151751 6/1997 Japan .

*Primary Examiner*—Charles G. Freay
*Attorney, Agent, or Firm*—Wenderoth, Lind & Ponack, L.L.P.

[57] ABSTRACT

An air separator for a gas turbine, in which cracks are prevented from occurring at a flange portion of the air separator due to fretting fatigue. The air separator (20) has a cylindrical split structure formed by two separator members (20-1 and 20-2), of which one of the separators (20-1) is mounted on a rotor (1) whereas the other separator member (20-2) is mounted on a disc portion (7) on a side of a moving blade (2) by bolts (28) extending through bolt holes (23) formed in a flange portion (22). Cooling air from a compressor enters a space (6) from a duct (5) and passes to a passage (32) from a clearance (33) so that it is fed to air feed holes (43) and radial holes (44) of the disc portion (7). Alternatively, air holes (50) are provided in the flange portion (22) in the form of circumferential slots for covering a plurality of radial holes to feed the cooling air homogeneously so that a prior art air separator of an existing plant can be replaced.

8 Claims, 6 Drawing Sheets

AIR SEPARATOR FOR GAS TURBINES

This is a national stage application under 35 U.S.C. 371 of International application No. PCT/JP98/02688, filed Jun. 18, 1998.

BACKGROUND OF THE INVENTION

1. Technical Field

The present invention relates to an air separator for a gas turbine, which has a structure capable of preventing cracks at the air separator end portion and distributing cooling air homogeneously to a plurality of first stage moving blades.

2. Description of Related Art

An air separator for a gas turbine is a device for guiding cooling air for a rotor and moving blades from a compressor. FIG. 8 is a section of an air separator for a prior art gas turbine, and FIG. 9 is a perspective view. In FIG. 8, reference numeral 1 designates a rotor, and numeral 2 designates a first stage moving blade mounted on the rotor 1 through a disc portion 7 so that it rotates together with the rotor 1. Numeral 3 designates a first stage stator blade, and numeral 4 designates a seal ring retaining ring inside of the stator blade 3. Numeral 5 designates a duct for guiding cooling air 30 from a compressor into a space 6. The numeral 7 designates the aforementioned disc portion on which the root of the moving blade 2 is mounted, and numeral 8 designates bolts/nuts. Numerals 41 and 42 designate seal portions on the stationary side, and numeral 43 designates air feed holes for feeding the cooling air to the downstream stage of the disc portion 7.

Numeral 10 designates an air separator which is formed into a cylindrical shape surrounding the rotor 1 and which has a flange portion 13 on its lefthand side and bolt holes 9 formed so that the air separator is mounted on the rotor 1 by the bolts/nuts 8. The air separator 10 has such a flange portion 12, which on its righthand side contacts with the disc portion 7 around its leading end portion. An air hole 11 is formed around the central portion of the air separator 10 for guiding the cooling air 30 from the space 6 via a passage 31, which is formed between the rotor 1 and the inner circumference of the air separator, into the air feed holes 43 of the disc portion 7 and further into radial holes 44 for guiding the air from the disc portion 7 to the first stage moving blade 2. On the other hand, the outer circumference of the air separator 10 is close to the seal portions 41 and 42 on the stationary side to prevent the cooling air from leaking to the outside through seal fins.

FIG. 9 is a perspective view of the air separator 10. This air separator 10 is formed into a cylindrical shape surrounding the rotor and has the numerous air holes 11 around its central portion, as described above, and the flanges 12 and 13 at its two ends. Of these, the flange portion 13 is mounted on the rotor 1 by the bolts/nuts through the bolt holes 9.

FIGS. 10(*a*)–10(*b*) show the flange portion of the air separator on one side of the moving blade, FIG. 10(*a*) is a section through the contacting portion of the flange portion and the moving blade, and FIG. 10(*b*) is a perspective view showing a state in which cracks occur in the flange portion. As shown in FIG. 10(*a*), the leading end portion of the flange portion 12 is lightly held in contact with the disc portion 7 of the rotor while keeping a constant facial pressure with the disc side.

As described above, the air separator 10 has the overhang structure in which it is fixed at flange portion 13 on the side of the rotor 1 by the bolts/nuts 8. The flange portion 12 at the other end abuts under the constant facial pressure against the disc side so that it rotates together with the rotor 1. After repeated hot restarts, therefore, the flange portion 12 may develop have a crack, as shown in FIG. 10(*b*).

The cause for this crack will be described. If a restart is made in a hot state after being stopped for several hours, and if the cold cooling air is fed to cool the air separator 10, the separator 10 is abruptly cooled to lower the holding force of the flange portion 12 on the disc portion 7. If the run is made under this lowered holding force, a relative slip occurs between the flange portion 12 and the disc abutting side so that the surface is roughed to cause fine cracks due to local stress. These fine cracks gradually open so that the opened portion is torn up by the centrifugal force to cause the crack, as shown in FIG. 10(*b*).

SUMMARY OF THE INVENTION

As described above, the air separator for the prior art gas turbine has the overhang structure in which it is fixed at its one end flange portion 13 on the side of the rotor by the bolts/nuts 8. The flange portion 12 at the other end abuts under the constant facial pressure against the disc side of the first moving blade so that it rotates together with the rotor 1, and the cooling air 30 from the compressor is fed through the space 31 on the rotor side to the air feed holes 43 on the side of the disc portion 7 and to the radial holes 44. After repeated hot restarts, therefore, slips occur between the flange portion 12 and the disc side, as described hereinbefore, so that the flange portion 12 is cracked and damaged by the resultant fretting fatigue.

Therefore, the invention has an object to provide an air separator for a gas turbine, which is freed from the occurrence of cracks at the flange portion by changing the structure of the air separator to eliminate the contact portion with the disc side and the relative slip at the contact portion. Another object of the invention is to provide an air separator for a gas turbine, which has a structure capable of distributing the cooling air homogeneously to a plurality of first stage moving blades even when the existing air separator of the prior art gas turbine is used as a replacement.

In order to achieve these objects, according to the invention, there is provided an air separator for a gas turbine, comprising front and rear cylindrical members halved in the direction of a rotor axis while keeping a predetermined clearance and arranged around a rotor. The front cylindrical member contacts closely around the rotor and forms a seal portion at its outer circumference together with a stationary side. Also, the rear cylindrical member maintains a rotor surrounding space communicating with the clearance and is arranged to have its end portion fixed on a disc portion on a first moving blade side and to construct a seal portion at its outer circumference together with a stationary side, so that cooling air is fed from the rotor surrounding space of the rear cylindrical member to the disc portion on the side of the first stage moving blade.

According to the invention, on the other hand, there is also provided an air separator for a gas turbine, comprising front and rear cylindrical members halved in the direction of a rotor axis while maintaining a predetermined clearance and arranged around a rotor. The front cylindrical member contacts closely around the rotor and forms a seal portion at its outer circumference together with a stationary side. The rear cylindrical member keeps a rotor surrounding space communicating with the clearance and forms a seal portion at its outer circumference together with a stationary side. The rear cylindrical member has a flange to be mounted on a disc portion on the first stage moving blade. Also, the flange has a plurality of bolt holes for connecting the disc portion and slots which are each formed between the adjoining bolt holes and extended circumferentially, so that cooling air is fed from the slots to radial holes of the disc portion on the side of the first stage moving blade.

According to the invention, more specifically, the air separator is constructed to include the two split cylindrical members, which are individually fixed on the discs on the rotor side and the first stage moving blade side so that the cooling air from the compressor is guided through the clearance between the split portions and is fed through the space between the rear cylindrical member and the circumference of the rotor to the disc portion on the first stage moving blade side. The individual cylindrical members are fixed independently of each other to form the seal portions around their outer circumferences together with the stationary side thereby to prevent the cooling air from leaking to the outside. Unlike the overhang structure of the prior art air separator in which only one front end of the air separator is fixed on the rotor side whereas the other rear end is fixed on the disc side, the contact portion with the disc portion is eliminated so that even repeated restarts will not establish a rubbing portion at the contact portion due to the thermal stress. As a result, the flange portion will not crack due to the fretting fatigue.

According to the invention, the air separator is split in the longitudinal direction of the rotor so that the cooling air from the compressor flows from the clearance of the split portions through the rotor surrounding space of the rear cylindrical member and is fed from the slots formed in the circumferential direction of the flange into the radial holes of the disc portion. Since the slots are formed in the disc portion mounting flange of the air separator, the cooling air is widely spread from the slots to the radial holes evenly arranged in the disc portion so that it can be homogeneously fed from any of the slots adjoining in the circumferential direction toward the confronting radial holes. These radial holes are evenly arranged but receive the cooling air while confronting any of the slots formed circumferentially in the flange of the air separator so that the cooling air is fed in substantially homogeneous flows to any of the radial holes.

When the existing air separator is remedied and replaced by the air separator of the invention, therefore, one of the slots can confront the plurality of circumferential radial holes, and the individual radial holes can confront any of the slots. As a result, the cooling air can be homogeneously fed to the individual radial holes, i.e., the plurality of first stage moving blades thereby to remedy the problems in the existing prior art type air separator.

DETAILED DESCRIPTION OF THE INVENTION

Figure 1:
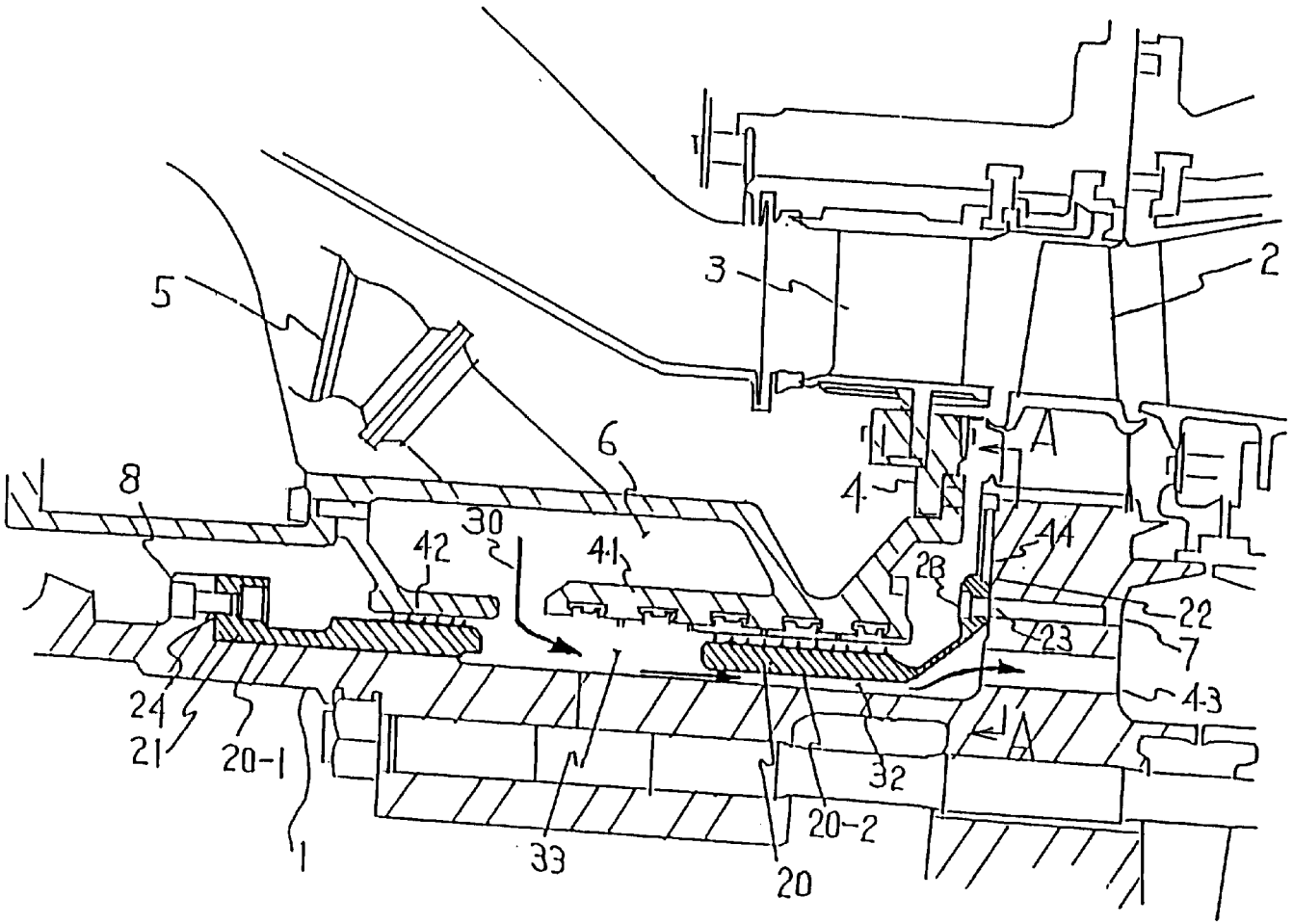
FIG. 1 is a sectional view showing an air separator for a gas turbine according to a first embodiment of the invention.
Figure 8:
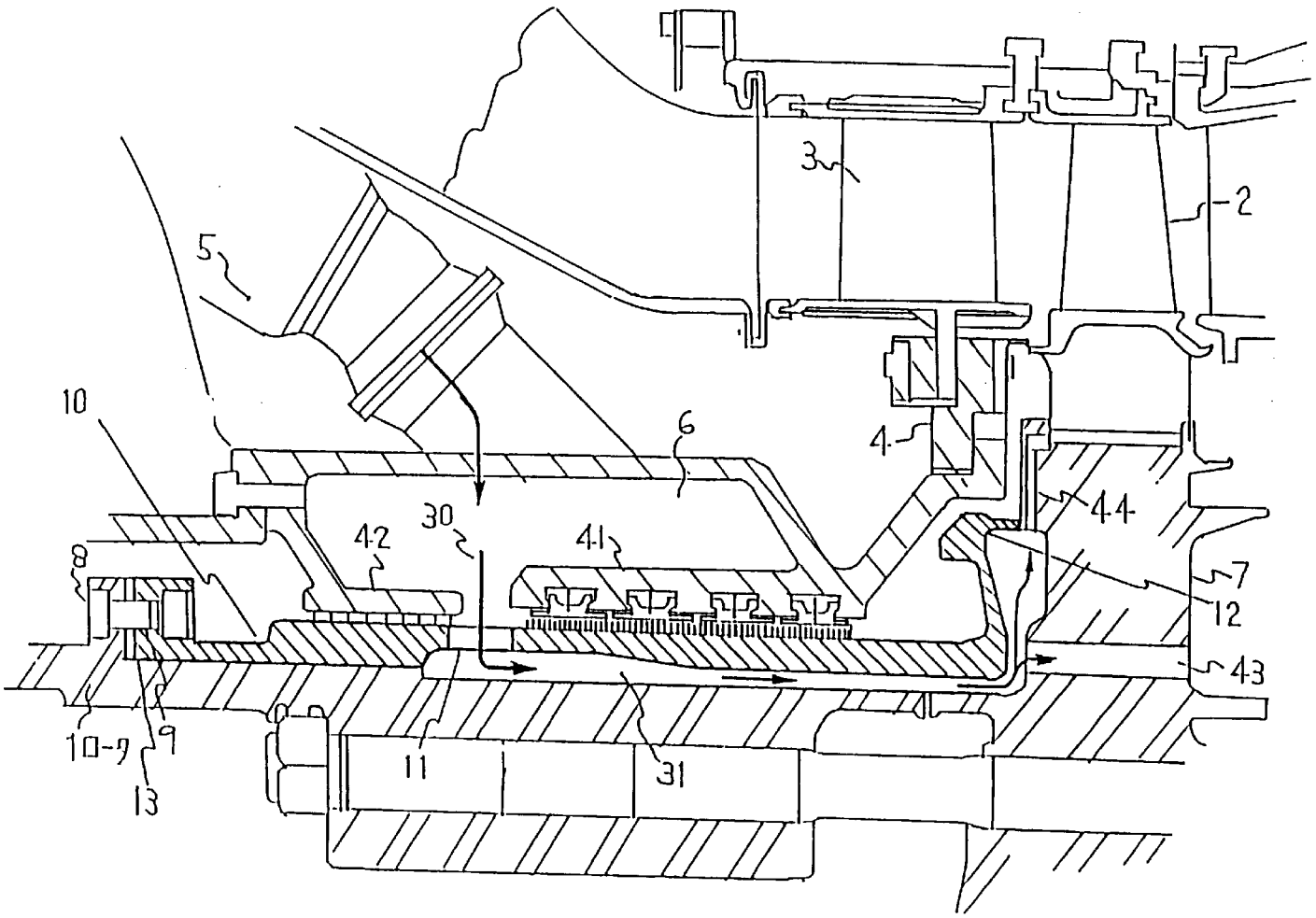
Fig. 8 (Prior Art)
FIG. 8 is a sectional view of an air separator of a prior art gas turbine.
Figure 9:
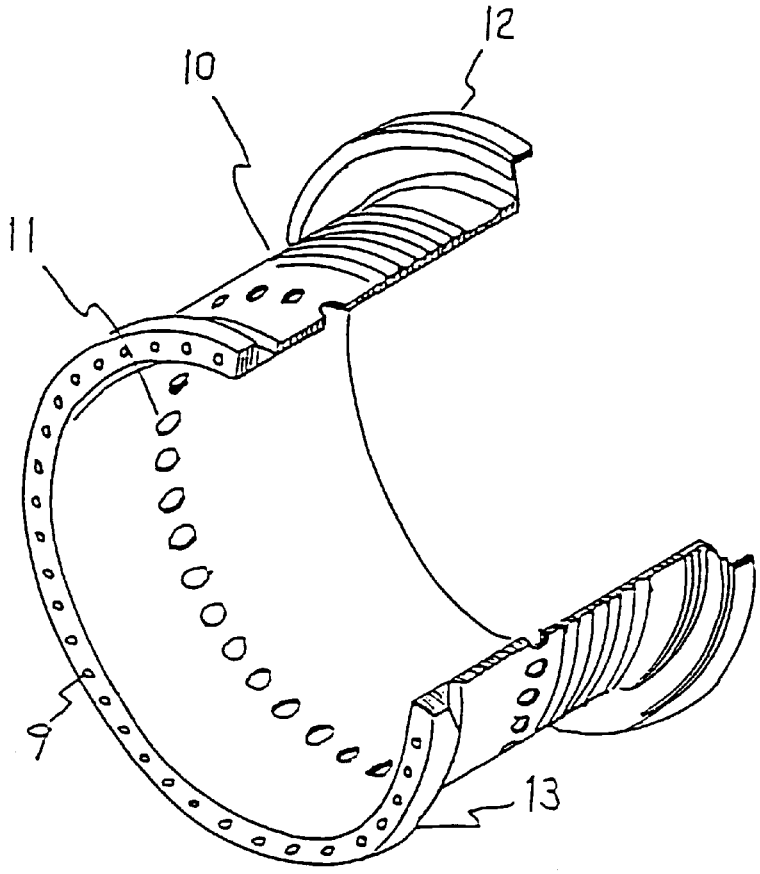
Fig. 9 (Prior Art)
FIG. 9 is a perspective view of the prior art air separator.
Figure 10A:
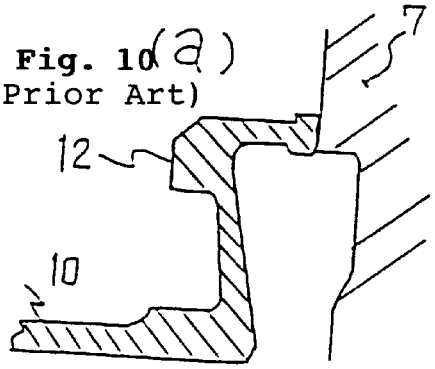
Fig. 10(a) (Prior Art)
FIGS. 10(*a*)–10(*b*) show an abutment portion of the prior art air separator on the moving blade side, FIG. 10(*a*) is a sectional view, and FIG. 10(*b*) is a perspective view showing the state in which a flange portion of the air separator cracks.
Figure 10B:
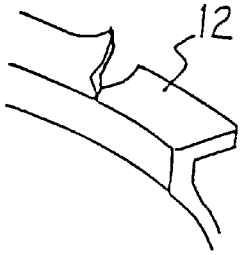
Fig. 10(b) (Prior Art)

A first embodiment of the invention will be specifically described with reference to the accompanying drawings. FIG. 1 is a sectional view showing an air separator of a gas turbine according to the first embodiment of the invention. In FIG. 1, reference numeral 1 designates a rotor, and numeral 2 designates a first stage moving blade which is mounted on the rotor 1 through a disc portion 7 so that it rotates together with the rotor 1. Numeral 3 designates a first stage stator blade, and numeral 4 designates a seal ring retaining ring inside of the stator blade 3. Numeral 5 designates a duct for feeding cooling air 30 from a compressor to a space 6. The numeral 7 designates the aforementioned disc portion, and numeral 8 designates a bolts/nuts. Numerals 41 and 42 designate seal portions on the stationary side; numeral 43 designates air feed holes for feeding the cooling air to a downstream stage; and numeral 44 designates radial holes. The construction thus far described is identical to that of the prior art example shown in FIG. 8.

Numeral 20 designates an air separator according to this embodiment, and this air separator 20 is formed into a cylindrical shape and has a structure split into separators 20-1 and 20-2. The separator 20-1 has a flange portion 21 at its end portion and is fastened on the rotor 1 by means of the bolts/nuts 8 so that it rotates together with the rotor 1. This separator 20-1 prevents the cooling air 30 from leaking into the space 6.

The separator 20-2 is arranged at a predetermined clearance 33 from the separator 20-1 and at a constant clearance 32 from the side of the rotor 1 and has a flange portion 22 at its one end. The flange portion 22 has bolt holes 23, through which the separator 20-2 is mounted on the disc portion 7 by means of bolts 28 so that it rotates together with the rotor 1.

As described above, the air separator 20 is composed of the separators 20-1 and 20-2 so that the cooling air 30 flows through the center split clearance 33 from the space 6 and is fed via the passage 32 into the air feed holes 43 of the disc portion 7 and into the radial holes 44. On the other hand, the separators 20-1 and 20-2 are close at their outer circumferences to the seal portions 41 and 42 on the stationary side so as to prevent the cooling air from leaking from the outer circumferences to the outside.

Figure 2:
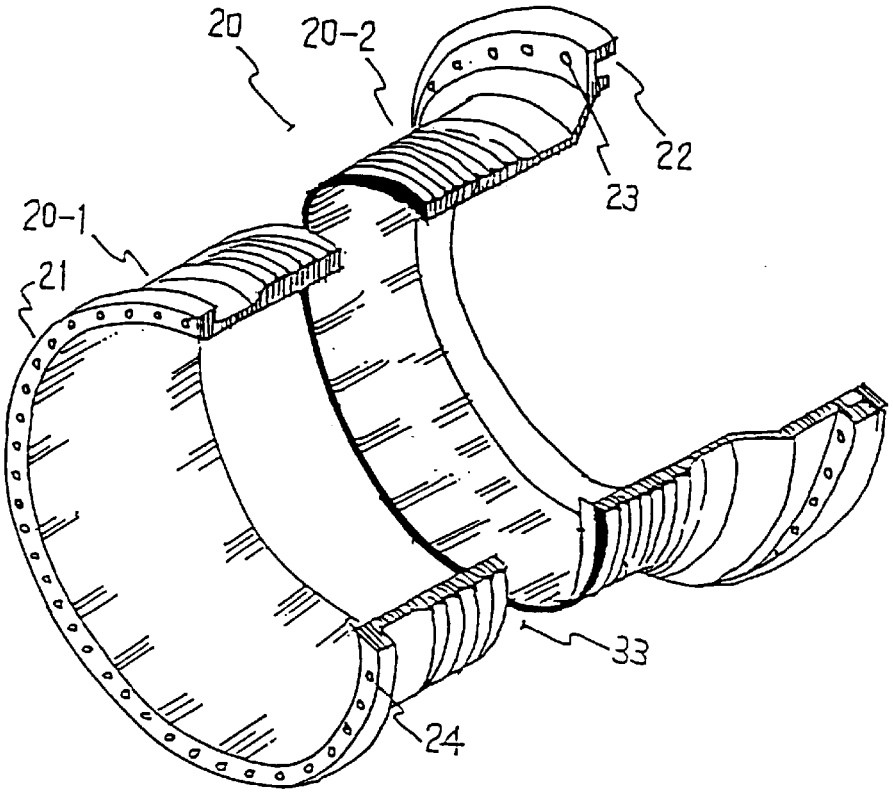
FIG. 2 is a perspective view showing the air separator according to the first embodiment of the invention.

FIG. 2 is a perspective view of the air separator 20 and shows the halved or two-part structure of the separators 20-1 and 20-2 and the cylindrical shape around the rotor 1. The separator 20-1 has at its one end the flange portion 21, which has around its circumference bolt holes 24 to be jointed to the rotor side. The separator 20-1 is arranged at its other end to confront the separator 20-2 while maintaining a constant clearance, and the separator 20-2 has at its other end the flange portion 22, which has bolt holes 23 to be connected to the disc portion 7 on the side of the first stage moving blade. The flange portion 22 is mounted throughout its circumference on the disc portion 7 on the side of the first stage moving blade 2 by inserting the bolts 8 into the bolt holes 23.

Figure 3:
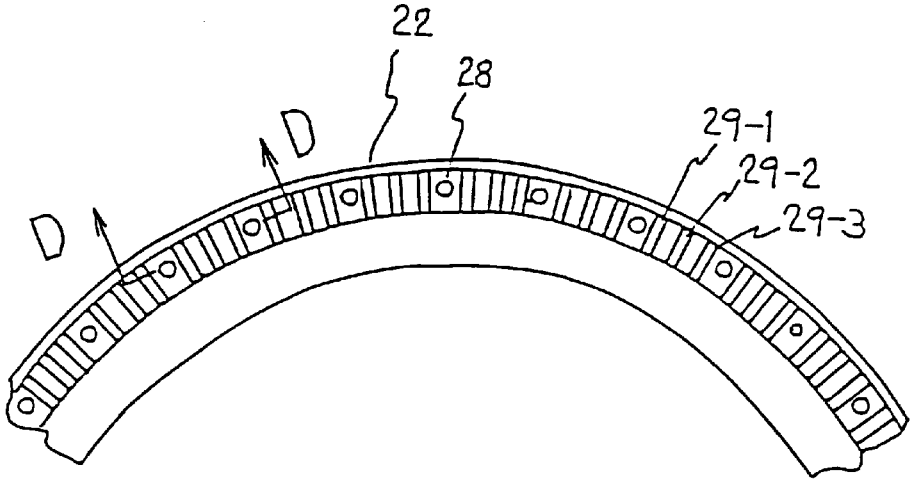
FIG. 3 is a sectional view taken in the direction of arrows A—A of FIG. 1 and shows a structure of air holes of the air separator according to the first embodiment of the invention.

FIG. 3 is an enlarged diagram of a portion of the flange portion 22 taken in the direction of arrows A—A of FIG. 1, and shows the mounting portion of the flange portion 22 on the disc portion 7. In FIG. 3, the flange portion 22 has a plurality of bolt holes 28, and three air holes 29-1, 29-2 and 29-3 formed between the adjoining bolt holes 28. These air holes 29 are formed into a semicircular shape in cross-section to provide cooling air passages in radial directions when the flange portion 22 is mounted on the disc portion 7. The air holes 29 guide the cooling air from the inside of the cylindrical air separator 20-2 into the numerous radial holes 44 formed in the disc portion 7 of the moving blade at a first stage.

Figure 5:
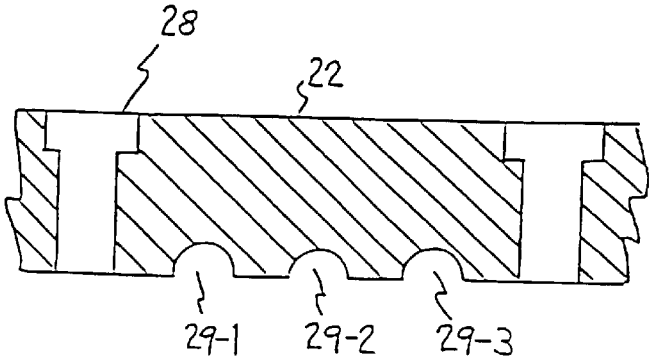
FIG. 5 is a sectional view taken in the direction of arrows D—D of FIG. 3.
Figure 4A:
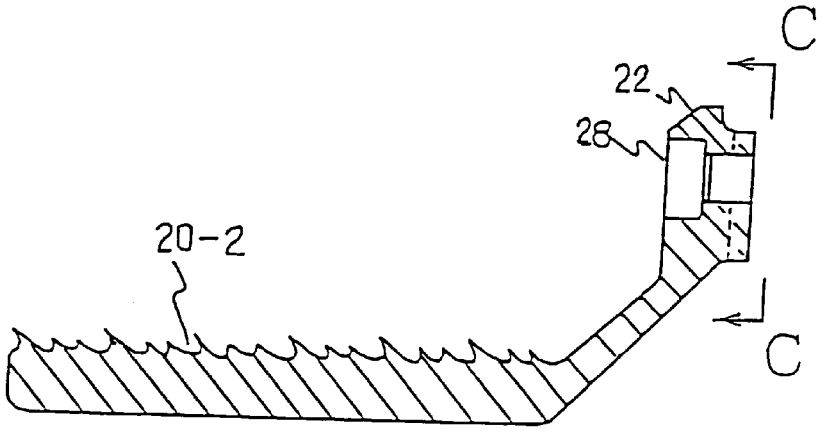
FIGS. 4(*a*)–4(*b*) show the downstream side of the air separator according to the first embodiment of the invention, FIG. 4(*a*) is a sectional view at the downstream side, and FIG. 4(*b*) is a view taken in the direction of arrows C—C of FIG. 4(*a*)
Figure 4B:
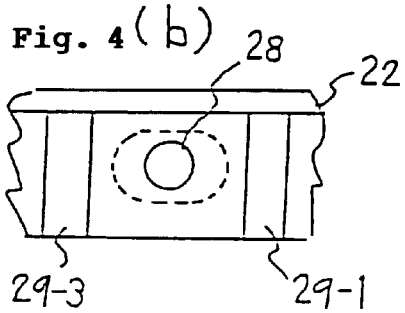

FIGS. 4(*a*)–4(*b*) show the downstream member 20-2 of the split type air separator shown in FIG. 1. FIG. 4(*a*) presents a longitudinal view, sectional and FIG. 4(*b*) is a view taken in the direction of arrows C—C of FIG. 4(*a*). As shown in FIG. 4(*a*), the outer circumference of the member 20-2 forms a seal portion confronting the stationary side, and the flange portion 22 has the bolt holes 28 and the air holes 29-1 to 29-3 extending in the vertical direction. FIG. 5 is a sectional view taken in the direction of arrows D—D of FIG. 3, and shows the semicircular air holes 29-1, 29-2 and 29-3, as described hereinbefore.

The air separator 20 thus constructed according to the first embodiment has the split structure formed by the separators 20-1 and 20-2. The cooling air 30 from the compressor flows from the duct 5 into the space 6 and further into the clearance 33 and is fed via the passage 32, as formed by the rotor 1 and the air separator 20-2, via the air holes 29-1, 29-2 and 29-3 and to the radial holes 44 of the disc portion 7 and to the air feed holes 43. On the other hand, the outer circumference of the air separator 20-1 forms the seal portion together with seal portion 42 on the stationary side, and the outer circumference of air separator 20-2 forms the seal portion together with the seal portion 41 on the stationary side, so that the cooling air is prevented from leaking to the outside.

In the air separator 20 of this embodiment, the separator 20-1 is fixed on the rotor side by the bolts 8, and the separator 20-2 is fixed on the disc side by the bolts 28 so that the air separator 20 rotates together with the rotor 1. Unlike the overhang structure of the prior art in which only one end is jointed by the bolts whereas the other end abuts against the side of the first stage moving blade 2, the contact portion with the rotor 1 is eliminated, and both of the flange portions 21 and 22 are connected by the bolts so that cracks are prevented from occurring due to the fretting fatigue of the flange portions.

In the first embodiment of the invention thus far described, the first stage disc portion 7 has the radial holes 44 in the same number as that of the first stage moving blades as those for feeding the cooling air of the first stage moving blade 2 of the turbine. Therefore, the air holes 29-1, 29-2 and 29-3 of the air separator are also preferred to be in the same number as the holes of the first stage moving blades 2, i.e., the radial holes 44. As shown in FIG. 3, however, the mounting bolt holes 28 are required in the flange portion 22 at which the air separator 20-2 is mounted on the disc portion 7. The space is reduced by the number of the bolts holes, and the air holes 29-1, 29-2 and 29-3 may be unable to be distributed evenly in accordance with the radial holes 44. This is because, although the radial holes 44 are arranged in the disc portion radially evenly so as to correspond to the plurality of first stage moving blades 2, the bolt holes 28 are arranged evenly for the stress and balance, as shown in FIG. 3, so that the air holes 29-1 to 29-3 of the air separator 20 are arranged between the bolt holes 28 and fail to correspond to the evenly arranged radial holes 44.

When the aforementioned embodiment of the invention is exemplified by 103 air holes in the first stage moving blades, 32 bolt holes have to be evenly distributed as the rotary member for balance. It is, however, impossible to arrange the 32 bolt holes evenly in the flange portion of the air separator and to arrange the 103 air holes evenly. When the prior art air separator is to be improved by changing the air separator with the split type air separator which is connected to the disc portion by the bolts, therefore, the air holes and the radial holes are not always aligned. The number of first stage moving blades is so relatively small and even that they can be evenly distributed. In the case of changing to the split type, however, it has been desired to realize the air separator which is constructed to feed the cooling air from the air separator evenly to each first step moving blade.

A second embodiment of the invention relates to an air separator for a gas turbine, which can meet those requirements. This air separator is of the split type shown in FIGS. 1 and 2, as in the foregoing embodiment, but is different from the first embodiment in the structure of the air holes which are formed in the flange portion 22 of the member 20-2.

Figure 6:
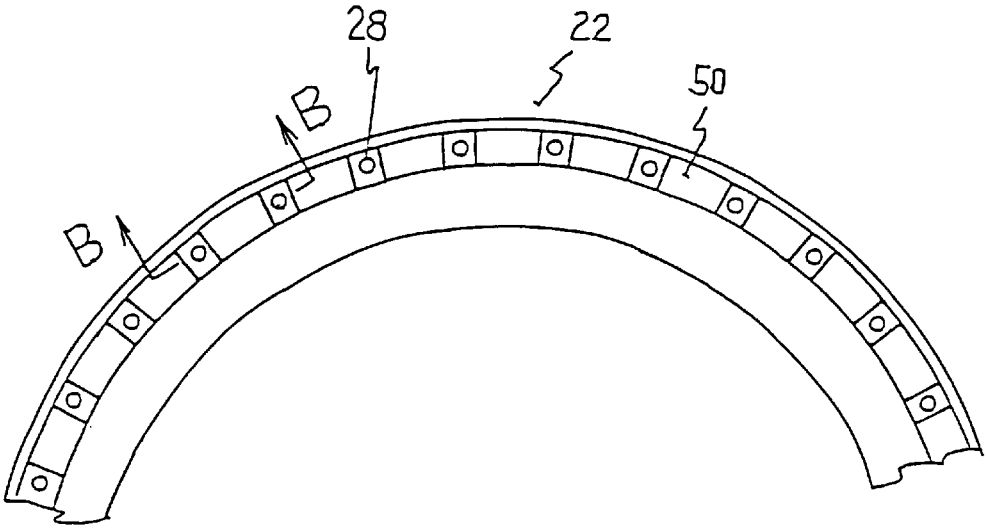
FIG. 6 is a sectional view taken in the direction of arrows A—A of FIG. 1 and shows the structure of air holes of an air separator according to a second embodiment of the invention.

In connection with the second embodiment of the invention, points different from those of the foregoing embodiment 1 will be mainly described with reference to FIGS. 6 and 7. FIG. 6 is a view taken in the direction of arrows A—A of FIG. 1, and shows a portion of the mounted portion of the flange portion 22 on the disc portion 7. As shown, the flange portion 22 is formed in a cylindrical shape enclosing the rotor 1 and has evenly arranged bolt holes 28. FIG. 6 shows a portion of the embodiment having 32 bolt holes 28, and the air separators 20-1 and 20-2 are rotary members rotating at high speeds so that they have to be arranged and mounted evenly for balance.

Between the adjoining bolt holes 28, there are formed slot-shaped air holes 50. When air separator member 20-2 is mounted on the disc portion 7, the cooling air spreads widely from the scattered small air holes 29-1 to 29-3 of the aforementioned first embodiment into the radial holes 44, which are evenly arranged in the disc portion 7, and any slot-shaped hole of the second embodiment covers all of a plurality of radial holes so that the cooling air can be fed in substantially homogenous flows to any of the radial holes 44.

Figure 7A:
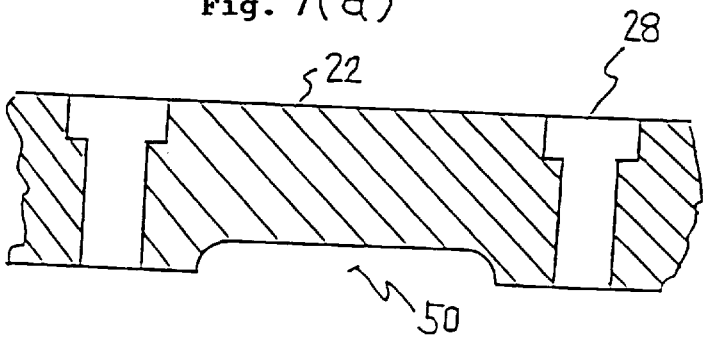
FIG. 7(*a*) is a sectional view taken in the direction of arrows B—B of FIG. 6, and FIG. 7(*b*) is an explanatory diagram comparing FIG. 7(*a*) and FIG. 5.
Figure 7:
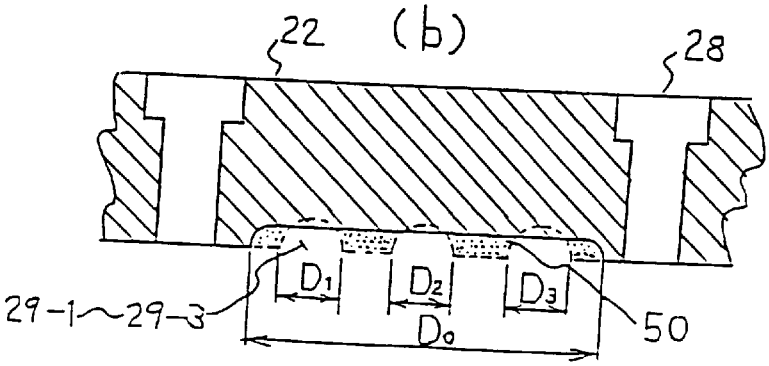

FIG. 7(*a*) is a sectional view taken in the direction of arrows B—B of FIG. 6, and FIG. 7(*b*) illustrates a contrast to the air holes of the first embodiment of FIG. 5. Between the bolt holes 28, there are formed the slot-shaped air holes 50 which have an opening having a larger width D0 than the opening width of D1+D2+D3 of the semicircular air holes 29-1 to 29-3 of the first embodiment, as indicated by dotted lines, and the same area as that of D1+D2+D3, so that they can confront the intervening radial holes 44 on the side of the disc portion 7 thereby to feed the cooling air homogeneously.

If the number of first stage moving blades is a prime number when the air separator of the prior art is to be replaced by the air separator 20 of the prior art, the bolt holes 28 have to be evenly arranged, but their air holes cannot always be arranged to correspond one-to-one to the existing radial holes 44. In the arrangement having the air holes 29-1 to 29-3 shown in FIG. 3, the radial holes 44 and the air holes 29-1 to 29-3 of the air separator can be designed to correspond to each other when the gas turbine is designed and manufactured. However, this design may be made impossible by remedying the existing gas turbine or by replacing the air separator.

In the case described above, the cooling air can be fed through each wide air hole 50 to the radial holes 44 by using the air separator having the slot-shaped air holes 50 according to the aforementioned second embodiment so that it can be homogeneously fed to the individual radial holes. In the repair of an existing gas turbine, therefore, the air separator can be replaced by that of the present invention thereby solving the aforementioned problems in the air separator of the gas turbine of the prior art.

Although the invention has been described in connection with its embodiments, it should not be limited thereto but may naturally be modified in various manners within its scope in connection with its specific structure.

According to the present invention, an air separator for a gas turbine is constructed to comprise front and rear cylindrical members separated in the direction of a rotor axis while keeping a predetermined clearance and arranged around a rotor. The front cylindrical member contacts closely around the rotor and forms a seal portion at its outer circumference together with a stationary side of the turbine. The rear cylindrical member forms a rotor surrounding space communicating with the clearance and is arranged to have its end portion fixed on a disc portion on a first moving blade side and forms a seal portion at its outer circumference together with a stationary side of the turbine, so that cooling air is fed from the rotor surrounding space of the rear cylindrical member to the disc portion on the side of the first stage moving blade. With this construction, unlike the prior art, the overhang structure is avoided, and the flange portions of the split members are individually fixed to the rotor leaving no contact portion so that cracks are prevented from developing in the flange portions due to the fretting fatigue. This structure improves the reliability of the gas turbine.

According to the second embodiment of the present invention, air separator for a gas turbine includes front and rear cylindrical members separated in the direction of a rotor axis while maintaining a predetermined clearance and arranged around a rotor, such that the front cylindrical member contacts closely around the rotor and forms a seal portion at its outer circumference together with a stationary side of the turbine. The rear cylindrical member keeps a rotor surrounding space communicating with the clearance and forms a seal portion at its outer circumference together with a stationary side of the turbine, such that the rear cylindrical member has a flange to be mounted on a disc portion on the first stage moving blade. Also, the flange has a plurality of bolt holes for connecting the disc portion and slots each formed between adjoining bolt holes and extending circumferentially, so that cooling air can be fed from the slots to radial holes of the disc portion on the side of the first stage moving blade. With this construction, the cooling air can be homogeneously fed from the slots to all of the radial holes. At the time of remedying the existing plant, on the other hand, the air separator of the present invention can be easily replaced without detrimentally affecting the cooling effect. In the existing plant, too, it is possible to solve the problem of the occurrence of cracks at the flange portion due to the fretting fatigue of the air separator of the prior art and to enhance the cooling efficiency.

What is claimed is:

1. An air separator for a gas turbine, said air separator comprising:

a front cylindrical member closely contacting a rotor and including a seal portion formed on an outer circumferential surface of said front cylindrical member for forming a seal in conjunction with a stationary side of the gas turbine; and a rear cylindrical member surrounding the rotor so as to define a rotor surrounding space, said rear cylindrical member having an end portion fixed to a disc portion of a first stage moving blade, and a seal portion formed on an outer circumferential surface of said rear cylinder for forming a seal in conjunction with a stationary side of the gas turbine, wherein said front cylindrical member is spaced from said rear cylindrical member along a direction of a rotor axis so as to define a predetermined clearance communicating with the rotor surrounding space so that cooling air can be fed from the rotor surrounding space to the disc portion.

2. The air separator as claimed in claim 1, wherein said front cylindrical member includes a flange portion having a plurality of axially extending bolt holes for securing said front cylindrical member to the rotor.

3. The air separator as claimed in claim 1, wherein said end portion of said rear cylindrical member includes a plurality of uniformly spaced bolt holes and a plurality of radially extending semi-cylindrical slots opposing the disc port ion.

4. The air separator as claimed in claim 3, wherein at least two of said semi-cylindrical slots are disposed between each pair of said bolt holes that are disposed adjacent to each other.

5. An air separator for a gas turbine, said air separator comprising:

a front cylindrical member arranged around and closely contacting a rotor, said front cylindrical member having an outer circumferential seal portion engaging a stationary side of the gas turbine; and a rear cylindrical member arranged around the rotor so as to define a rotor surrounding space, said rear cylindrical member having an outer circumferential seal portion for sealingly engaging a surface of a stationary side of the gas turbine, and a flange to be mounted on a disc portion on a first stage moving blade, said flange having a plurality of bolt holes and a plurality of radially extending slots formed between adjacent bolt holes that are disposed adjacent to each other in order to permit cooling air to be fed from said slots to radial holes of the disc portion, wherein said front cylindrical member is spaced from said rear cylindrical member along a direction of an axis of the rotor so as to define a predetermined clearance between said front and rear cylindrical members, said clearance communicating with the rotor surrounding space so that cooling air can be fed from the predetermined clearance through the rotor surrounding space and then through said slots to the radial holes of the disc portion.

6. The air separator as claimed in claim 5, wherein said front cylindrical member includes a flange portion having a plurality of axially extending bolt holes for securing said front cylindrical member to the rotor.

7. An air separator for a gas turbine, said air separator comprising:

a first cylindrical member arranged around and closely contacting a rotor, said first cylindrical member having an outer circumferential seal portion engaging a stationary surface of the gas turbine; and a second cylindrical member arranged around the rotor so as to define a rotor surrounding space, said second cylindrical member having an outer circumferential seal portion for engaging a stationary surface of the gas turbine, and a flange capable of being mounted on a disc portion of a first stage moving blade, said flange having a plurality of bolt holes and a plurality of radially extending slots located between said bolt holes, respectively, such that cooling air can be fed from said slots to radial holes of the disc portion of said first stage moving blade, wherein each of said slots is wide enough to communicate with a plurality of the radial holes of the disc portion, and wherein said front cylindrical member is spaced from said rear cylindrical member along a direction of a rotor axis so as to define a predetermined clearance that communicates with the rotor surrounding space.

8. The air separator as claimed in claim 7, wherein said front cylindrical member includes a flange portion having a plurality of axially extending bolt holes for securing said front cylindrical member to the rotor.

* * * * *